US005737858A

United States Patent [19]

Levy

[11] Patent Number: 5,737,858

[45] Date of Patent: Apr. 14, 1998

[54] TRAINING DEVICE FOR SOCCER PLAYERS

[76] Inventor: Mark H. Levy, 10050 Westpark #1904, Houston, Tex. 77042

[21] Appl. No.: 616,205

[22] Filed: Mar. 15, 1996

[51] Int. Cl.[6] ..... A43B 13/18; A43B 5/02

[52] U.S. Cl. ..... 36/128; 36/132; 36/133; 36/7.5

[58] Field of Search ..... 36/128, 132, 136, 36/133, 72 R, 77 R, 7.1 R, 7.2, 7.3, 7.4, 7.5, 7.7

[56] References Cited

U.S. PATENT DOCUMENTS

| | | | |
|---|---|---|---|
| 900,499 | 10/1908 | Eckhard, Jr. | 36/7.4 |
| 1,439,873 | 12/1922 | Dicarlo | 36/7.7 |
| 1,464,365 | 8/1923 | Koetter | 36/7.7 |
| 1,811,781 | 6/1931 | Degge | 36/7.5 |
| 1,850,752 | 3/1932 | Ice et al. | 36/128 |
| 2,300,091 | 10/1942 | Barry | 36/7.7 |
| 2,796,684 | 6/1957 | Montgomery . | |
| 3,191,321 | 6/1965 | Brutting | 36/133 |
| 3,525,165 | 8/1970 | Randall, Jr. | 36/128 |
| 3,650,051 | 3/1972 | Sass | 36/128 |
| 3,851,410 | 12/1974 | Frazier | 36/133 |
| 4,194,310 | 3/1980 | Bowerman | 36/128 |
| 4,422,249 | 12/1983 | Hannah . | |
| 4,458,432 | 7/1984 | Stempski . | |
| 4,866,861 | 9/1989 | Noone . | |
| 5,216,827 | 6/1993 | Cohen . | |
| 5,301,442 | 4/1994 | Williams . | |

FOREIGN PATENT DOCUMENTS

| | | | |
|---|---|---|---|
| 0496931 | 8/1992 | European Pat. Off. | 36/133 |
| 2255628 | 5/1974 | Germany | 36/133 |
| 2259639 | 3/1993 | United Kingdom | 36/133 |

*Primary Examiner*—M. D. Patterson

*Attorney, Agent, or Firm*—Bush, Riddle, & Jackson, L.L.P.

[57] ABSTRACT

Soccer training shoes are provided having ball contact elements that cause a soccer ball to more readily bounce away from the foot of the user. In one aspect of the invention, a training device is provided for temporary attachment to the shoe of a soccer player for providing hard inside and outside ball contact elements that cause a soccer ball to more readily bounce away from the foot of the user and thus promote the development of the "soft feel" that is desirable for catching, trapping and dribbling activities. The training device is essentially in the form of a web of straps that encompass the toe and instep portion of a soccer shoe and with forward, intermediate and rear transverse straps each being provided with a relatively hard ball contact element for location along the vamp of a soccer shoe in the immediate region of the inside and outside edges of the sole of the shoe. The transverse straps are positioned so as to place the ball contact elements in closely spaced relation to collectively define an elongate strip of relatively hard ball contact material on the inside and outside edges of the soccer shoe. The web of straps defining a major portion of the training device may be composed of elastic material to permit the device to be easily assembled to and disassembled from a soccer shoe. In another aspect of the invention, soccer shoes may have ball contact elements permanently or releasable attached to them. Shoes may be originally manufactured with ball contact elements molded therein or attached thereto. Used soccer shoes may be converted to training shoes by permanent or releasable attachment of ball contact elements thereto.

14 Claims, 2 Drawing Sheets

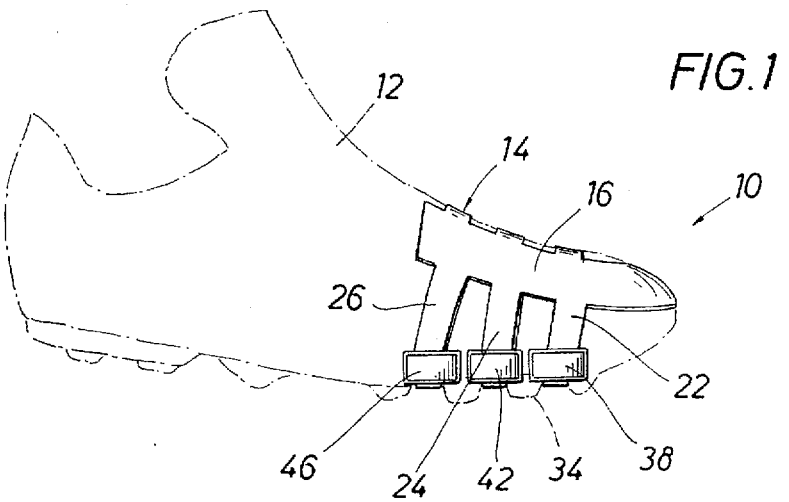
FIG. 1
FIG. 2
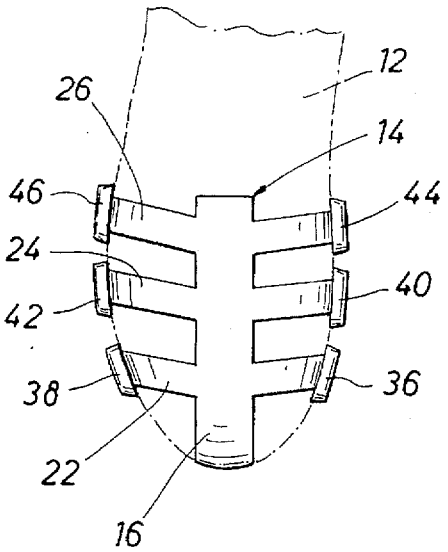
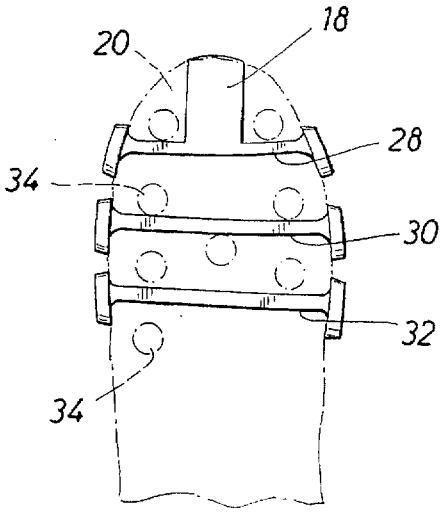
FIG. 3
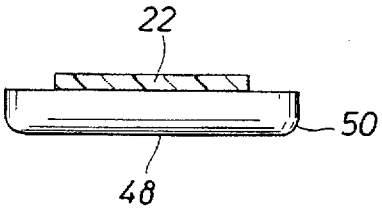
FIG. 4
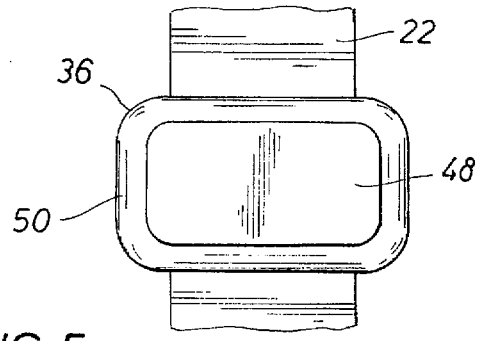
FIG. 5

FIG. 6
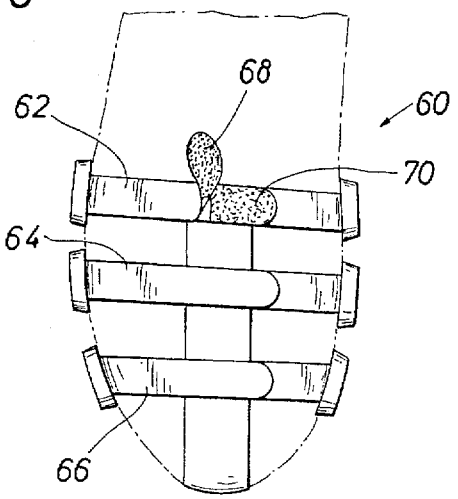
FIG. 7
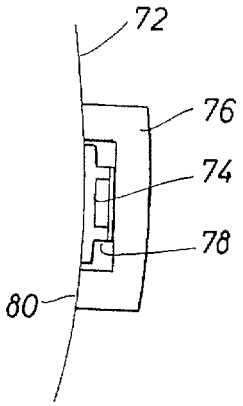
FIG. 8
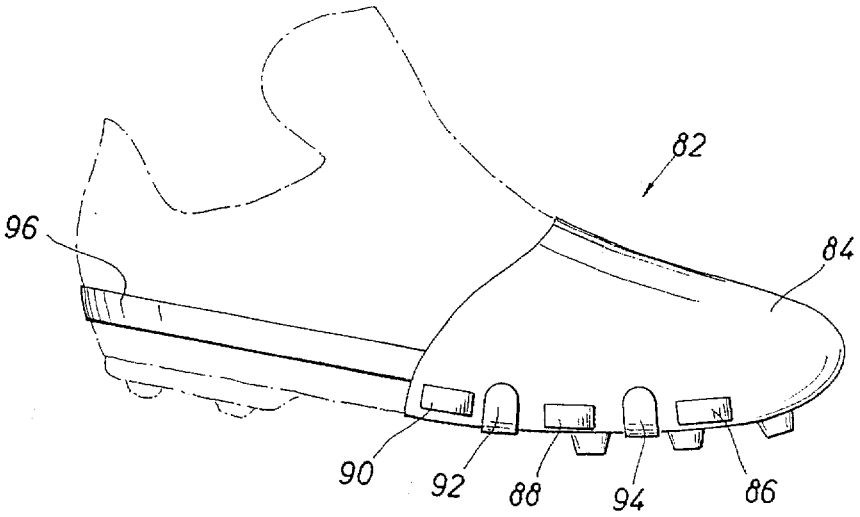
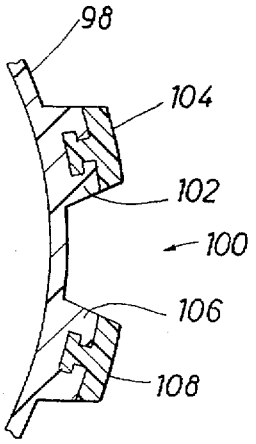
FIG. 9
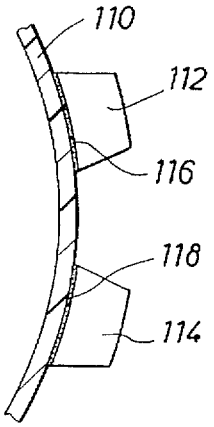
FIG. 10
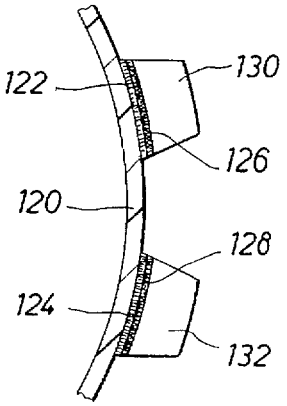
FIG. 11

TRAINING DEVICE FOR SOCCER PLAYERS

FIELD OF THE INVENTION

This invention relates generally to the sport of soccer as it is called in the United States and Futbol as it is called in many other countries of the world, and includes soccer played outdoors as well as indoors. More particularly, one aspect of this invention concerns a training device that is intended to be temporarily attached to a soccer shoe being worn by a player and which presents relatively hard ball engaging elements at inside and outside portions of the soccer shoe which engage a soccer ball being caught, trapped or dribbled and which cause a soccer ball to more readily bounce away from the foot of the player when so engaged. Another aspect of this invention is to provide a soccer shoe having one or more ball engaging element projecting form inside and outside portions thereof for the same purpose. By practicing, catching, trapping and dribbling a soccer ball while wearing the training device on one or both shoes a player will quickly determine the "soft feel" that is appropriate for proper catching, trapping and dribbling activities. Thus, when the training device is removed or when training shoes are replaced with regulation shoes for actual play the practicing soccer player will be more likely to catch, trap and dribble a soccer ball during play with the soft feel or contact that is necessary for maintaining it close to the feet for efficient control.

BACKGROUND OF THE INVENTION

Though the playing of soccer or futbol is a primary sport in many countries of the world, in the United States soccer has become an important sport only in the past fifteen to twenty years. Consequently in the United States many hundreds of soccer teams have been established most of which are manned by players having limited skills. Additionally, many immigrants from other countries are residing in the United States at the present time. Since soccer is the world's most important sport in terms of numbers of players and numbers of countries in which the sport is played, the immigrants, for the most part, continue to play the game of soccer in this country and thus enhance the importance of the sport in the United States. Coaches for the sport of soccer have determined that one of the more difficult aspects of soccer training is the training of an individual in ball handling, i.e. catching, trapping and dribbling. During catching and trapping, a soccer ball is passed from one player to another, often at relatively high velocity. The catching or trapping player will contact the ball with the foot in such manner that the ball is essentially stopped but stopped with a soft feel so that it does not bounce significantly away from the catcher's foot. It is well known that players have a difficult time developing this soft feel or soft catching capability so that the ball when stopped often bounds away from the foot of the catching player. As such, the ball can be easily intercepted by an opposing player. When the soccer ball is caught or trapped by a player who yields the catching foot so as to develop the soft catching feel, the ball will be stopped and will remain close to the player's foot thereby providing the catching player with efficient control of the ball. The same occurs upon dribbling the ball as the player runs with it. If the ball is hit hard with the foot it will bound away from the dribbling player so that it can be easily intercepted by an opposing player.

It is desirable therefor to provide a soccer training shoe having one or more relative hard ball contact elements which project from inside and/or outside portions of the vamp and toe of the shoe, adjacent to the sole of the shoe and which cause a soccer ball to more readily bounce away from the foot of the practicing player. It is also desirable to provide a device which can be temporarily attached to one or both of the shoes of a soccer player that provide the same benefits immediately described above but also will allow the player to remove the device so that the shoes may be worn during an actual game. Since a soccer ball will more readily bound away from the foot of the user upon contact therewith the practicing player will readily learn the manner by which a soccer ball is to be contacted to maintain efficient control over it. Afterwards, in normal practice or regular play the practice shoe is not worn or soccer training device is not present on the player's shoe so that the soft feel that the player develops through use of the training device or training shoe will provide the player with the capability for more effective catching, trapping and dribbling of a soccer ball.

SUMMARY OF THE INVENTION

It is a principal feature of the present invention to provide a novel training device for temporary attachment to a soccer shoe for assisting soccer players in the development of the "soft" and controlled ball contact that is desirable for catching, trapping and dribbling a soccer ball and maintaining efficient control of the ball.

It is also a feature of this invention to provide a novel practice shoe for soccer training activities having at least one and preferably a plurality of relatively hard ball contact thereon which function to cause a soccer ball contacted thereby to more readily bounce away from the foot of the wearer unless catching, trapping and dribbling activities are done with soft feel contact with the ball.

It is another feature of the present invention to provide a novel training device for soccer shoes which incorporates relatively hard ball contact elements and positions them at respective inside and outside edge portions of the vamp of the soccer shoe and which cause a soccer ball to readily bounce away from the soccer shoe unless contact is made therewith in a manner providing soft and controlled ball contact.

It is also a feature of the present invention to provide a novel temporary training device for soccer shoes which can be efficiently attached to or removed from a soccer shoe in a few minutes time so that the shoe can be used during training exercises and can then be used in actual play without requiring any special tools or equipment for tools or assembly or disassembly thereof from the soccer shoe.

It is also a feature of the present invention to provide a novel temporary training device for soccer shoes which can be efficiently attached to a soccer shoe by means of hook and loop fastener material of the kind that is typically sold under the registered trademark VELCRO.

It is another feature of this invention to provide a novel temporary training device for soccer shoes having retainer straps which essentially encompass both the top and bottom portions of the shoe and yet which do not interfere with the traction that is normally afforded by the cleats of the shoe.

It is an even further feature of this invention to provide a novel temporary training device for soccer shoes which is enabled to cover the toe of a soccer shoe and to be temporarily attached to the shoe by a fastening strap that extends about the heel of the shoe.

It is also a feature of the present invention to provide a novel temporary training device for soccer shoes which can be efficiently attached to a soccer shoe by means of snaps, wherein the shoe is provided with snaps that are molded into or otherwise fixed to the sides of the shoe and bounce pads, typically of rectangular configuration, may be temporarily attached to the sides of the shoe by snap connection.

It is an even further feature of the present invention to provide a novel temporary training device for attachment to soccer shoes and which incorporates a plurality of support straps each essentially encompassing the toe and instep portions of the shoe and wherein each of the straps individually provides support for a hard ball contacting element so that the plural straps support a plurality of ball contact elements each arranged in side-by-side relation to provide relatively hard inside and outside ball contact areas.

It is also a feature of the present invention to provide for novel temporary attachment of various devices for practice or play to soccer shoes and other types of shoes by means of one or more support straps.

It is another feature of this invention to provide a novel soccer training shoe which is worn only for training and which is originally manufactured or retrofitted with relatively hard ball contact projections for soccer training activities to improve soccer ball catching, trapping and dribbling.

Briefly, the various objects and features of one aspect of the present invention are realized through the provision of a training device that may be molded from a resilient material and which defines a plurality of retainer bands that are integrally connected to one another and define a web that essentially encompasses the toe and instep portion of a soccer shoe. The web is defined by a center strap that extends along the instep of a soccer shoe and extends over the toe of the shoe. From this central strap extend a plurality of spaced lateral straps each of which essentially encompass side and bottom portions of a soccer shoe in such manner as to lie in the spaces between the cleats of a soccer shoe. The central strap and lateral straps are composed of resilient or elastic material and thus provide the device with a close fit to the upper side and lower portions of a soccer shoe. The straps extending along the sole of the shoe are thin and do not interfere significantly with the cleats of the soccer shoe.

Each of the lateral straps of the training device provides support for an individual hard ball contact member and may if desired by composed of the same material as the soccer shoe cleats, i.e. hard rubber. These hard ball contact elements may also be composed of a wide range of other materials if desired. The ball contact elements are of a configuration and dimension so as to lie in closely spaced relation along the respective inside and outside surfaces of a soccer shoe so that collectively they provide an elongate, flexible but hard contact area on these inside and outside surfaces of the player's shoe. Thus, when a soccer ball is trapped, caught or dribbled these relatively hard ball contact elements will cause the ball to more readily bounce away from the shoe of the user. Thus, in order to minimize this "bounce away" characteristic the player will quickly develop the "soft feel" that is necessary for maintaining sufficient control of the ball while catching, trapping or dribbling it.

After having used the device for a sufficient period of time that this "soft feel" has been developed, the player will then remove the training device from the shoe and engage in normal soccer play. The player's capability at that point for efficient and controlled catching, trapping or dribbling activities will then determine if additional training is appropriate. Typically, a player will use the training device periodically to enhance that player's skills in ball control during the play of soccer.

In another aspect of this invention, soccer shoes are provided having permanent ball contact elements projecting from the inside and outside ball contact areas thereof. These permanent ball contact elements or buttons may be provided on or in the structure of the shoe in any suitable manner. For example, as an alternative, a shoe may be manufactured by a molding process wherein the ball contact elements are molded into the inside and outside ball contact areas of the shoe. As a further example, a worn soccer shoe or a shoe designated solely for training purposes may be provided. Relatively hard ball contact areas of the shoe by bonding material, adhesive or by any other suitable means. Shoes of this nature will be worn only during training activities.

BRIEF DESCRIPTION OF THE DRAWINGS

The present invention has the above as well as other objects, features and advantages which will become more clearly apparent in connection with the following detailed description of a preferred embodiment, taken in conjunction with the appended drawings.

In the drawings:

FIG. 1 is a side elevational view of a soccer training device manufactured in accordance with the present invention, being shown in full line and being shown in assembly with a soccer shoe shown in broken line.

FIG. 2 is a plan view of the soccer training device of FIG. 1 being shown in full line and being shown in assembly with a soccer shoe shown in broken line.

FIG. 3 is a bottom view of the soccer training device of FIGS. 1 and 2, being shown in full line and being shown in assembly with a soccer shoe partially shown in broken line.

FIG. 4 is a sectional view of one of the transverse straps of the soccer training device of FIGS. 1–3, showing a ball contact element in supported relation therewith.

FIG. 5 is a partial elevational view the transverse strap of FIG. 4, showing the configuration of the preferred ball contact element.

FIG. 6 is a partial plan view similar to that of FIG. 2 and showing a temporary training device for soccer shoes which is attached to the shoe by means of hook and/or loop fastener straps.

FIG. 7 is a sectional view showing a portion of a shoe such as a soccer shoe and further showing removable connection of a ball contact element to the shoe by means of a snap connection.

FIG. 8 is an elevational view showing a shoe by means of broken lines and in full line showing a training device being received over the toe of the shoe and being temporarily secured to the shoe by a strap extending about the heel of the shoe.

FIG. 9 is a partial sectional view of the welt portion of a soccer shoe showing ball contact elements being incorporated into the shoe structure during the manufacturing process.

FIG. 10 is a partial sectional view of the welt portion of a soccer shoe showing relatively hard soccer ball contact elements being retained in assembly therewith by means of bonding agent, an adhesive or by any other suitable retaining means.

FIG. 11 is a partial sectional view of the welt portion of a soccer shoe having relatively hard ball contact elements, releaseably retained in assembly therewith by means of hood and loop fastener material or the like.

DETAILED DESCRIPTION OF PREFERRED EMBODIMENT

Referring now to the drawings and first to FIGS. 1 and 2 a soccer training device manufactured in accordance with the present invention is shown generally at 10 and is shown in assembly with a soccer shoe shown in broken line at 12. The soccer training device may be of generally web like configuration, being defined by a plurality of interconnected straps or bands which essentially encompass the toe and instep portion of a soccer shoe. The web shown generally at 14 may be composed of resilient or elastic material which may integral if desired. The web 14 may encompass a central web strap 16 which is oriented to extend along the instep and toe portion of a soccer shoe and to extend about the toe to define a bottom central strap section 18 that is adapted to be essentially oriented along the surface of the sole 20 of the shoe as shown in FIG. 3.

A plurality of transverse straps or bands, being a front strap 22 and intermediate strap 24 and a rear strap 26 extend transversely from the central web strap 16 and are each oriented to encompass side and bottom portions of a soccer shoe. Each of the front, intermediate and rear straps 26 may if desired be formed integrally with the central web strap as shown in FIGS. 1 and 2. In this case, the entire web system, including the central web strap 16 and the front, intermediate and rear transverse straps 22, 24, and 26 can be defined molding or by any other suitable manufacturing process. Also if desired the transverse straps may be bonded, sewn or otherwise attached to the central web strap without departing from the spirit and scope of the present invention. As shown in FIG. 3 the transverse straps will have bottom strap portions shown at 28, 30 and 32 which are oriented to lie along the surface of the sole 20 of the soccer shoe and will be oriented so as to clear the various soccer shoe cleats 34. These bottom strap portions will be of relatively thin and flat configuration and thus will not substantially interfere with the traction of the cleats with respect to the turf of the surface of a soccer field. The bottom portion 18 of the central web strap 16 may be integrally connected with the bottom portion 28 of the front transverse strap 22 as shown in FIG. 3 so the forward portion of the central web strap 16 will extend over the toe 19 of the soccer shoe in rather taut manner so that it will essentially conform to the toe of the shoe and the forward portion of the sole 20 near the toe of the shoe. Since the bottom transverse strap 28 will be oriented rearwardly of the forward cleats of the shoe the bottom portion 18 of the central web strap will lie along the bottom surface of the sole 20 of the shoe and therefore will not have any tendency to move away from the sole of the shoe during soccer practice where it might otherwise interfere with the cleats of the shoe.

As mentioned above, it is desirable to provide a soccer training device for temporary attachment to a soccer shoe and which provides relatively hard inside and outside ball contact areas that essentially cause a soccer ball to more readily bounce away from the shoe of the player when ball contact is made. This "bounce away" characteristic is effectively achieved within the scope of the present invention through the provision of a plurality of relatively hard ball contact elements which are secured to the soccer training device in such manner as to be located along the inside and outside surfaces of a soccer shoe in the region of the toe and instep portions of the soccer shoe. In accordance with the preferred embodiment of this invention the front transverse web strap 22 of the soccer training device is provided with an inside ball contact element 36 and outside ball contact element 38 which are supported respectively by side portions of the front transverse strap. These hard ball contact elements 36 and 38 may be bonded to the side portions of the front transverse strap by any suitable bonding agent or by any other suitable means of attachment. It may also be desirable to attach the hard ball contact elements to the transverse straps during the molding operation for the training device itself. This can be accomplished by placing hard ball contact elements into a mold, closing the mold and then injecting a resilient or elastic polymer material into the mold. Upon curing of the polymer material in the mold the ball contact elements will be permanently secured in assembly with the respective transverse straps. The intermediate transverse strap 24 will be provided with inside and outside ball contact elements 40 and 42 while the rear transverse strap 26 will be provided with inside and outside ball contact elements 44 and 46 respectively. Thus when oriented as shown in the Figures the ball contact elements will collectively define elongate inside and outside ball contact strips which are intended to be located along the inside and outside areas of the vamp of the shoe adjacent the respective inside and outside edges of the sole and in the generally region of the instep portion of the shoe. Each of the hard ball contact elements may be composed of any one of a variety of suitable relatively hard materials such as hard rubber, polymers or plastics or metals. These ball contact elements may conveniently have the configuration shown in FIGS. 4 and 5 where they may be of generally rectangular configuration and may define relatively flat ball contact surfaces 48 and tapered edges 50. the particular configuration shown in FIGS. 4 and 5 however is not intended to be limiting of the spirit and scope of the present invention. Alternatively, the ball contact elements may be of round or oval configuration without departing from the spirit or scope hereof. The closely spaced relation of the ball contact elements when the soccer training device is in assembly with a soccer shoe, accommodate the flexibility of the instep portion of a soccer shoe and yet permit the location of relatively hard elongate strips of material to provide the "bounce away" characteristics that are desired for soccer training. Although the soccer training device 10 as shown in the drawings is preferably a molded device being integrally formed of a suitable polymer or rubber like material such is not intended to limit the spirit and scope of the present invention. If desired, the device may be sewn of fabric or fabric like strap material and provided with buckles for tightening or provided with Velcro strips for temporary attachment to the shoe of a soccer player. The device shown in FIGS. 1–3 is assembled to a soccer shoe simply by yielding the elastic straps of the webbing in such manner that the forward, intermediate and rear straps are placed between the cleats of the bottom of the shoe essentially as shown in FIG. 3 while the upper portion of the device, including the central web strap 16 and the transverse straps are pulled over the toe and instep area of the shoe. It is not necessary to use any tools or equipment to assemble the device to a soccer shoe or to remove it when normal play desirable. During its use when a soccer shoe is brought into contact with a ball the hard ball contact elements will tend to cause the ball to more readily bounce away from the foot of the user. To prevent the ball from bouncing away in this manner the user will necessarily contact the ball "soft feel", i.e. by yielding the foot away from the ball to a certain extent so that the ball will always remain in a relatively close and controlled relation with the foot of the user to prevent it from being intercepted by opposing players after contact has been made. A soccer player will therefore be able to quickly develop the "soft feel" that is necessary for efficient control of a soccer ball during catching, trapping and dribbling activities in connection with soccer play. During normal play the user will simply remove the device from the soccer shoe by yielding the elastic, rubber like strips or straps thereof so that the bottom strap portions 28, 30 and 32 are moved clear of the cleats and the upper web portion including the central web strap 16 and the forward, intermediate and rear transverse are removed from the toe and instep area of the shoe. The training device can be simply and efficiently attached to the shoe while the shoe is being worn by the user or if desired the shoe may be removed from the foot of the user for attachment or removal of the training device.

Referring now to FIG. 6 there is shown an embodiment of the present invention wherein a training device of the character and purpose that is described above is temporarily attached to an athletic shoe such as a soccer shoe by means of hook and loop type fastener straps. The temporary training device is shown generally at 60 and may be of the same general configuration and purpose as is described in connection with FIG. 2. Instead of integral fastening straps, however, the training device 60 is provided with releasable fastening straps 62, 64 and 66 which are provided at the free ends thereof with respective patches of hook and loop fastener material such as is shown at 68 on strap 62. The web-like strapping of the training device is then provided with opposite hook or loop fastener patches such as shown at 70. Assembly of the training device to the shoe is accomplished simply by placing the training device in desired relation with the shoe and then pulling the fastener straps to desired tightness and securing them with the hook and loop fastener patches. Removal of the device from the shoe can be accomplished in a few seconds time by releasing the hook and loop fastener straps from the fixed fastener patches and then removing the device from its assembly with the shoe.

Referring now to FIGS. 7 and 8, the bounce away type ball contact element may be removably attached to a training device of the nature shown in FIGS. 1–6 or as shown in FIG. 8. To the outer surface 72 of the training device a conventional snap element is fixed in any suitable manner. The snap device defines a snap connection 78 that receives a hard bounce-away type ball contact element 76 in snap connection therewith. When the bounce-away ball contact elements are properly installed, their inner surfaces 80 are in engagement with the surface 72 of the training device. Thus, the ball contact elements of the training device are removable and thus are replaceable with other like ball contact devices.

As shown in FIG. 8, a ball contact training device shown generally at 82 is provided in the form of a toe cup 84 which is adapted to fit over the toe portion of the shoe shown in broken line. The toe cup 84 is provided with bounce-away type hard ball contact elements 86, 88 and 90 and with other ball contact elements 92 and 94. The toe cup is held in assembly with the shoe by a heel strap 96 as shown. The ball contact elements may be of the form shown in any of the Figs. of the drawings hereof, including removable ball contact elements as shown in FIGS. 7 and 11 hereof.

Referring now to FIGS. 9 and 10, soccer training shoes of original manufacture or of retrofitted manufacture may be provided having bounce-away type ball contact elements thereon. As shown in FIG. 9, the molded polymer welt portion 98 of a soccer shoe shown generally at 100 may be provided with a plurality of ball contact elements 102 and 106 that may be molded into the structure of the shoe during the shoe manufacturing process. If hard ball contact material is required for proper bounce-away characteristics relatively hard polymer inserts 104 and 108 may be molded into the ball contact elements during the manufacturing process.

According to the illustration of FIG. 10, the welt 110 of a soccer shoe, even a used soccer shoe that is being retrofitted for use in training activities, may be provided with permanently attached ball contact elements. As shown, relatively hard ball contact elements 112 and 114 may be permanently secured in assembly with the soccer shoe by means of an adhesive, bonding agent, sewing or the like as shown at 116 and 118 or by any suitable means of attachment and/or incorporation into or onto the shoe.

As shown in FIG. 11, ball contact elements may be releaseably attached to a soccer shoe by any suitable means. The shoe welt section 120 is shown to be provided with hook and loop fastener patches 122 and 124 that are fixed to the shoe structure. Opposite hook and loop fastener patches 126 and 128 that are fixed to ball contact elements 130 and 132 and are placed in fastening assembly with respective fastener patches 122 and 124 to secure the ball contact elements in position for effective use. The ball contact elements may be removed from the shoe simply by applying sufficient force to separate the hook and loop fastener patches. They are applied to the shoe simply by pressing the fasteners patches together.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A training device for an indoor or outdoor soccer shoe having a cleated sole defining inside and outside edges and having a vamp defining toe, instep, inside and outside vamp areas adjacent the sole, said training device assisting soccer players in learning the soft and controlled ball contact that is desirable for trapping and dribbling a soccer ball, said training device comprising:

(a) a flexible retainer for removable assembly about the toe, instep, inside and outside vamp areas and cleated sole of a soccer shoe and having a plurality of interconnected straps defining upper strap means adapted to be received about the toe, instep, inside and outside vamp areas of a soccer shoe and lower strap means adapted to be received about the cleated sole of the soccer shoe and to extend between the cleats of the cleated sole and to lie along the bottom surface of the sole, said upper strap means comprising; and (i) a central strap adapted to extend over the toe of the soccer shoe and having connection at one end thereof with said lower strap means; and (ii) front, intermediate and rear straps each being interconnected with said central strap and extending transversely therefrom, said front, intermediate and rear straps each being connected to said lower strap means; and (b) a plurality of relatively hard ball engaging elements being fixed to and projecting outwardly from respective ones of said front, intermediate and rear straps of said upper strap means of said flexible retainer and being positioned on said front, intermediate and rear straps for location adjacent respective inside and outside vamp surface areas of the soccer shoe at locations thereon being near the inside and outside edges of the cleated sole of the soccer shoe and in position for contact with a soccer ball during ball trapping, catching and dribbling activities, said relatively hard ball engaging elements having ball contact surfaces collectively defining ball contact bounce-away strips causing a soccer ball to readily bounce away from the soccer shoe of a soccer player thus enabling the soccer player to learn to yield the ball contacting foot during catching and trapping activity and thus learn the soft feel that is necessary for ball control.

2. The training device of claim 1 wherein said plurality of interconnected straps of said flexible retainer comprising:

(a) a strap web having front, intermediate and rear strap loops each adapted to extend about the top and bottom of a soccer shoe and with bottom portions of said strap loops adapted for positioning between the cleats of the soccer shoe; and (b) said plurality of relatively hard ball engaging elements being individually supported by said front, intermediate and rear strap loops in position for location thereof at spaced locations along respective inside and outside regions of the vamp of the soccer shoe immediately above the inside and outside edges of the soccer shoe and in position for contact with a soccer ball being contacted by the soccer shoe during trapping, catching and dribbling activities.

3. The training device of claim 2, wherein:

said plurality of relatively hard ball contacting elements being composed of hard rubber and defining a relatively flat ball engaging surface.

4. The training device of claim 2, wherein:

said plurality of relatively hard ball contacting elements being composed of a relatively hard polymer material and defining relatively flat ball engaging surfaces.

5. The training device of claim 1 wherein said flexible retainer comprises:

(a) a central web strap adapted to extend along the instep region of a soccer shoe and to extend over the toe of the soccer shoe and along the front portion of the toe of the soccer shoe;

(b) front, intermediate and rear strap loops each being in connection with said central web strap and being located in spaced relation along the length thereof, each of said front, intermediate and rear strap loops being adapted to extend about the vamp and sole of the soccer shoe and to lie along the surface of the sole at locations between the cleats of the soccer shoe; and (c) said plurality of relatively hard ball engaging elements each defining relatively flat ball engaging surface being individually supported in spaced relation by said front, intermediate and rear strap loops and being positioned on said front, intermediate and rear-strap loops for located of said relatively hard ball engaging elements at respective inside and outside regions of the vamp of the soccer shoe immediately above the inside and outside edges of the soccer shoe and in position for contact with a soccer ball being contacted by the soccer shoe during trapping, catching and dribbling activities.

6. The training device of claim 5, wherein:

said central web strap and said front, intermediate and rear strap loops being integrally connected and being composed of an elastic material.

7. A training device for temporary attachment to an indoor or outdoor soccer shoe having a cleated sole defining inside and outside edges and having a vamp defining toe, instep, inside and outside vamp areas adjacent the sole of the soccer shoe, said training device assisting soccer players in learning the soft and controlled ball contact that is desirable trapping, catching and dribbling a soccer ball, said training device comprising:

(a) a flexible retainer being defined by upper strap means and lower strap means for assembly about the toe, instep, inside and outside vamp areas and cleated sole of a soccer shoe, said lower strap means being received about the cleated sole of the soccer shoe and along the bottom surface of the sole, said upper strap means of said flexible retainer having a central web strap adapted to extend over the toe of a soccer shoe and having front, intermediate and rear web straps being interconnected with said central web strap and extending transversely therefrom, said front, intermediate and rear web straps being interconnected with said lower strap means; and (b) a plurality of relatively hard ball engaging elements being fixed to individual straps of said upper strap means of said flexible retainer and being disposed in spaced relation for positioning adjacent respective inside and outside vamp surface areas of the soccer shoe at locations thereon being near the inside and outside edges of the cleated sole of the soccer shoe and in position for bounce-away contact with a soccer ball during ball trapping, catching and dribbling activities, said ball engaging elements each defining a relatively flat ball engaging surface and collectively defining bounce-away ball engaging strips that assist players in the development of the soft feel that is necessary for ball trapping, catching and dribbling.

8. The training device of claim 7, wherein:

said plurality of relatively hard ball engaging elements are composed of hard rubber.

9. The training device of claim 7, wherein:

said plurality of relatively hard ball engaging elements are composed of a relatively hard polymer material.

10. The training device of claim 7 wherein:

(a) said central web strap adapted to extend along the instep region of a soccer shoe and to extend over the front portion of the toe of the soccer shoe;

(b) said front, intermediate and rear web straps each being integral with said central web strap and being located in spaced relation along the length of said central web strip, each of said front, intermediate and rear web straps being adapted to extend about the vamp and sole of the soccer shoe and to lie along the surface of the sole at locations between the cleats of the soccer shoe; and (c) said plurality of relatively hard ball engaging elements being individually supported in spaced relation by said front, intermediate and rear web straps for collectively defining said relatively hard bounce-away ball engaging strips at respective inside and outside regions of the vamp of the soccer shoe immediately above the inside and outside edges of the soccer shoe and in position for contact with a soccer ball being contacted by the soccer shoe during trapping, catching and dribbling activities.

11. The training device of claim 10, wherein:

said central web strap and said front, intermediate and rear strap loops being integrally connected and being composed of an elastic material.

12. The training device of claim 10, wherein:

said plurality of relatively hard ball contacting elements are composed of a relatively hard polymer material and define generally flat ball engaging surfaces.

13. The training device of claim 7, wherein said flexible retainer comprises:

(a) a central web strap adapted to extend along the instep region of a soccer shoe and to extend over the toe of the soccer shoe and along the front portion of the toe of the soccer shoe;

(b) front, intermediate and rear strap loops each being in connection with said central web strap and being located in spaced relation along the length thereof, each of said front, intermediate and rear strap loops being adapted to extend about the vamp and sole of the soccer shoe and to lie along the surface of the sole at locations between the cleats of the soccer shoe; and (c) said plurality of relatively hard ball engaging elements being individually supported in spaced relation by said front, intermediate and rear strap loops for positioning thereof at respective inside and outside regions of the vamp of the soccer shoe immediately above the inside and outside edges of the soccer shoe and collectively defining relatively hard ball engaging strips positioned for contact with a soccer ball being contacted by the soccer shoe during trapping, catching and dribbling activities.

14. The training device of claim 7, wherein:

said central web strap and said front, intermediate and rear straps being integrally connected and being composed of an elastic material.

* * * * *